United States Patent [19]

Majewski et al.

[11] Patent Number: 4,546,961

[45] Date of Patent: Oct. 15, 1985

[54] APPARATUS FOR AND METHOD OF GATHERING 1-UP AND 2-UP SIGNATURES FOR SADDLE STITCHING

[75] Inventors: Anthony Majewski, Warsaw, Ind.; Theodore W. Mayer, Chicago, Ill.

[73] Assignee: R. R. Donnelley & Sons Company, Chicago, Ill.

[21] Appl. No.: 642,079

[22] Filed: Aug. 20, 1984

[51] Int. Cl.[4] ..... B42B 1/02

[52] U.S. Cl. ..... 270/53; 198/644

[58] Field of Search ..... 270/53–54, 270/58; 198/644

[56] References Cited

U.S. PATENT DOCUMENTS

| | | | |
|---|---|---|---|
| 1,236,909 | 8/1917 | Christensen | 198/644 |
| 1,651,122 | 11/1927 | Huffert | 196/644 |
| 2,810,468 | 10/1957 | Faeber et al. | 198/644 |
| 3,362,304 | 1/1968 | Skolnick | 270/53 |
| 3,819,173 | 6/1974 | Anderson et al. . | |
| 3,899,165 | 8/1975 | Abram et al. . | |
| 3,902,708 | 9/1975 | Wise et al. . | |
| 3,917,252 | 11/1975 | Harder et al. . | |
| 4,121,818 | 10/1978 | Riley et al. . | |
| 4,236,706 | 12/1980 | Schlough | 270/53 |

*Primary Examiner*—E. H. Eickholt

*Attorney, Agent, or Firm*—Wood, Dalton, Phillips, Mason & Rowe

[57] ABSTRACT

Apparatus for gathering printed signatures for saddle stitching includes an endless gathering chain divided by pusher lugs into 2-up signature receiving areas, with each receiving area divided by a short pusher leg into a leading segment and a trailing segment, each adapted to receive a 1-up signature. At least one 1-up signature is first fed into at least one of the segments of each receiving area, and at least one 2-up signature is then fed into each receiving area overlying the 1-up signatures. The last signature is usually a 2-up cover; additional 1-up signatures may have been fed into trailing segments on top of any 2-up signature before the cover is fed, and a 1-up wrapper may be fed onto the trailing part of the 2-up cover.

14 Claims, 9 Drawing Figures

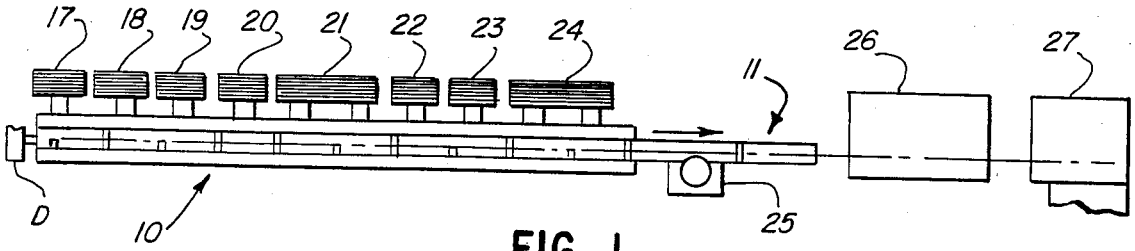
FIG. 1
FIG. 2
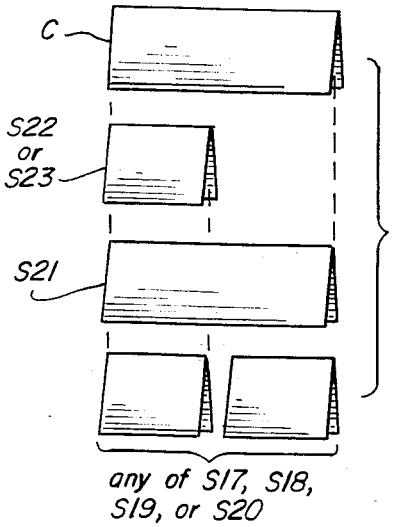
FIG. 3
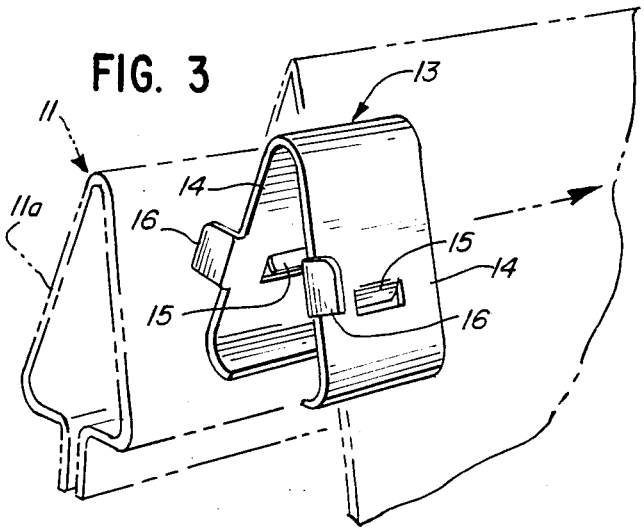
FIG. 4
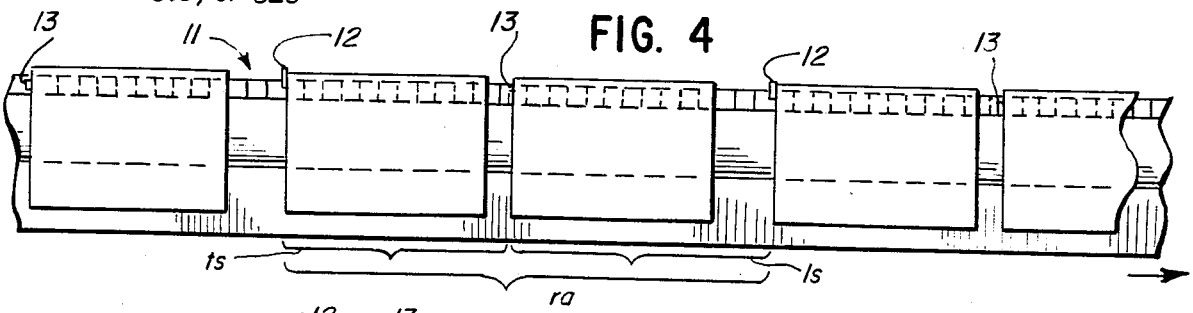
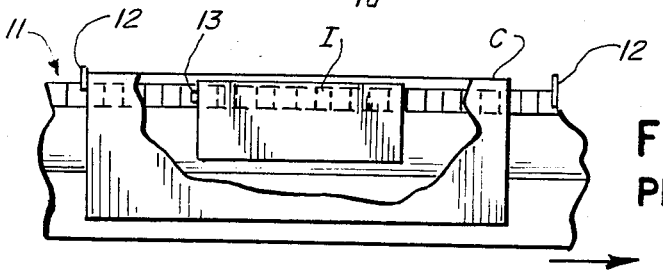
FIG. 5
PRIOR ART
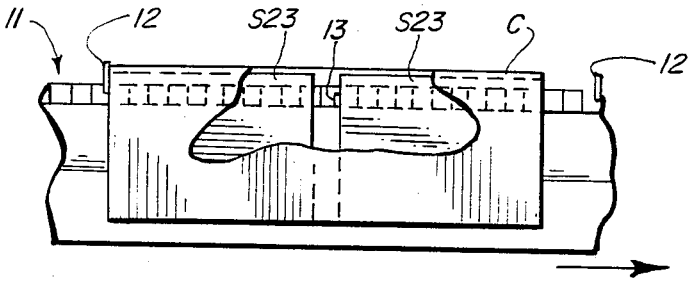
FIG. 6

APPARATUS FOR AND METHOD OF GATHERING 1-UP AND 2-UP SIGNATURES FOR SADDLE STITCHING

FIELD OF THE INVENTION

This invention relates to apparatus for and method of gathering printed signatures for saddle stitching; and more particularly, it relates to an apparatus and method for selectively feeding both 1-up and 2-up signatures onto a gathering chain in such a way that they may be stitched, cut and trimmed as though they were all 2-up signatures.

BACKGROUND ART

The designations 1-up and 2-up have been used in the bindery industry to identify distinct operating modes. In the 1-up mode, printed signatures used to compose individual books are consecutively gathered, bound and trimmed serially along a bindery line. The basic 2-up operation differs from 1-up in that each 2-up signature usually consists of identically printed halves married along a common edge. After stitching the books formed of 2-up signatures are divided to provide separate books.

Heretofore bindery lines have operated either in the 1-up mode or in the 2-up mode. The 1-up mode provides maximum flexibility, while the 2-up mode provides a high output rate because each operation in the bindery line is performed on two books simultaneously.

1-up bindery systems provide maximum flexibility in customizing of books according to the special interests of a subscriber or the special needs of people in particular areas of the country. Individual bindery lines can be controlled to produce customized books for a specific destination with individual books that have special pages for particular subscribers; and there may be inserts and/or customized ink jet printing on selected signatures internally of the books. Also possible is the elimination of otherwise burdensome and complicated sorting by postal zone which is required to comply with postal regulations and to take advantage of attractive postal discounts, and there is also very easy bundling of books for the most efficient and economical nonpostal delivery.

The type of flexibility which is possible in modern 1-up bindery systems is demonstrated in U.S. Pat. Nos. 3,899,165 (Abram et al.) and 4,121,818 (Riley et al.), both assigned to the assignee of this invention.

Less sophisticated systems than those disclosed in the above identified patents, but which nevertheless permit the customizing of magazines and catalogs, are taught in U.S. Pat. Nos. 3,819,173, 3,902,708, 3,917,252, and there are several others which relate to various aspects of customized gathering of books for saddle stitching.

There is very little freedom to customize books in the 2-up mode because the married pages of the 2-up signatures are usually identical, so books can be customized only in pairs.

The present invention, which mixes 2-up signatures and 1-up signatures in a single bindery line, provided for customization of books through the use of 1-up signatures, while the mixing of 2-up signatures with the 1-up, and the use of a 2-up cover, permits gathered signatures to be carried through the stitching and trimming stages as though they were entirely 2-up assemblies.

SUMMARY OF THE INVENTION

The apparatus of the present invention includes a line of several signature feeding stations to feed either 1-up or 2-up signatures to a gathering chain. The gathering chain has spaced signature pusher lugs that define receiving areas long enough for a 2-up signature, and short signature pusher legs alternating with the lugs to divide each receiving area into a leading segment and a trailing segment each of which is long enough for a 1-up signature. The length of the short pusher legs is such that a 2-up signature overlying a leg is not materially distorted. Each feeding station has the conventional mechanism for either feeding or not feeding a signature in accordance with a predetermined program; and the apparatus includes electronic programming means of a type commonly used in the gathering of customized books. In accordance with the invention, at least one 1-up signature is first fed into a leading or a trailing segment of each receiving area of the gathering chain, and thereafter at least one 2-up signature is fed into each chain receiving area overlying all the 1-up signatures and the pusher leg in each receiving area. Usually 1-up signatures will be fed into both the leading and trailing segments of each receiving area before feeding of the first 2-up signature.

After a 2-up signature has been fed into a receiving area, 1-up signatures may still be fed into a trailing chain segment overlying only the rearward page of a 2-up signature. The topmost signature, which is the cover for the gathered book, is a 2-up signature; although, if desired, an overwrap may overlie the trailing book cover.

THE DRAWINGS

FIG. 1 is a diagrammatic view of a bindery line embodying the invention;

FIG. 2 illustrates a typical sequence in which 1-up and 2-up signatures may be fed onto the gathering chain;

FIG. 3 is a perspective view of a pusher leg with the upper part of the chain and the rear upper part of a signature illustrated in broken lines and an arrow illustrating the direction of travel of the chain;

FIG. 4 is a diagrammatic view of a part of the gathering chain, pusher legs and pusher lugs, and a 1-up signature in each of the leading segments and trailing segments of successive receiving areas;

FIG. 5 is a fragmentary, diagrammatic illustration of a prior art apparatus in which a gathering chain with long pusher lugs and short pusher legs was used to feed inserts into double books consisting entirely of 2-up signatures;

FIG. 6 is a view similar to FIG. 5 illustrating the way in which two 1-up signatures are enveloped by a 2-up cover;

DETAILED DESCRIPTION OF THE INVENTION

Figure 7:
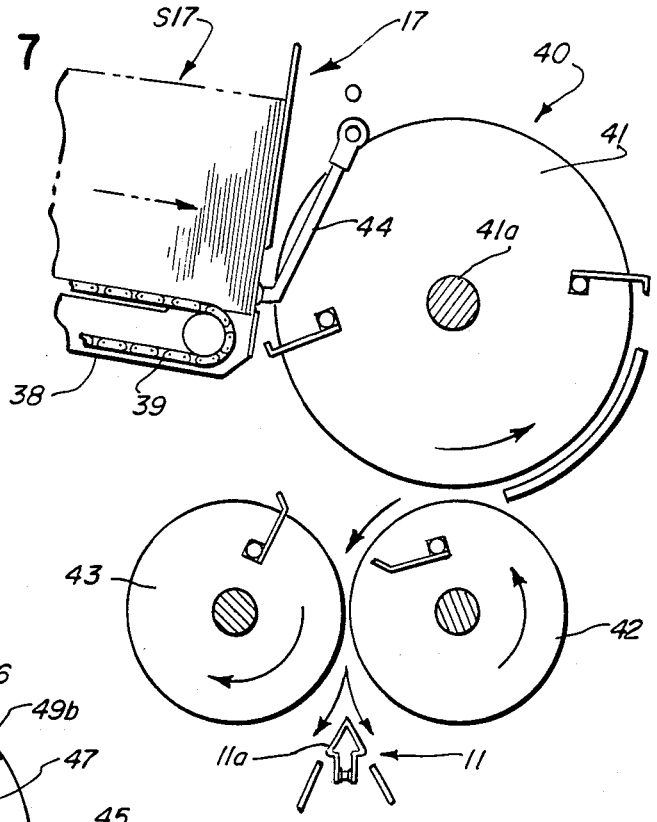
FIG. 7 is a diagrammatic view of a typical signature feeding station used in practicing the invention.

Referring to the drawings in detail, and referring first to FIGS. 1 and 3, a signature gathering machine, indicated generally at 10, has a gathering chain 11 provided with standard pusher lugs 12 and short pusher legs 13. As seen in FIG. 3, the pusher legs 13 have angularly related sides 14 with ears 15 that snap into openings in a saddle 11*a* of the gathering chain 11, and short legs 16 project laterally from the two sides 14. The legs 16 are short enough that they do not materially distort a 2-up signature overlying them.

A drive D runs the chain in the direction of the arrow in FIG. 1, and is also operatively connected to a line of several signature feeding stations, only a few of which are illustated diagrammatically in FIG. 1. One part of the stations in the line consists of 1-up signature feeding station 17, 18, 19, 20, 22 and 23; while another part of the stations in the line, numbered 21 and 24, are adapted to feed 2-up signatures. The feeding stations operate in a usual way which will be described broadly hereinafter to feed signatures onto the gathering chain 11 which conveys the packs of gathered signatures past a calipering station 25 that detects signature packs that are defective because they have either too many or too few signatures in them, then to a 2-up saddle stitcher 26, and then to a defective reject mechanism 27 which eliminates defective books from the line so that only perfect books proceed on for trimming, severing into individual books, and collection into groups for shipping.

All the components of the bindery line are individually known in the prior art, and it is only the arrangement which permits mixing of 1-up and 2-up signatures, and the actual mixing of them, that is the subject matter of the present invention.

Referring now to FIG. 7 which schematically illustrates any one of the signature feeding stations 17 through 24, the station 17 includes signature supply box means 38 provided with feed chains 39 which move a supply of signatures S17 forwardly as indicated by the arrow. Signature transfer drum means, indicated generally at 40, includes an extracting cylinder 41, a lap cylinder 42, and an opening cylinder 43, all of which are driven in the directions indicated by the arrows in FIG. 7. Conventional suction gripper means includes suction grippers 44 which are reciprocated in timed relationship with the rotation of the transfer drum means 40 in order to feed signatures from the supply box 38 to the saddle portion 11*a* of the gathering chain 11.

Figure 8:
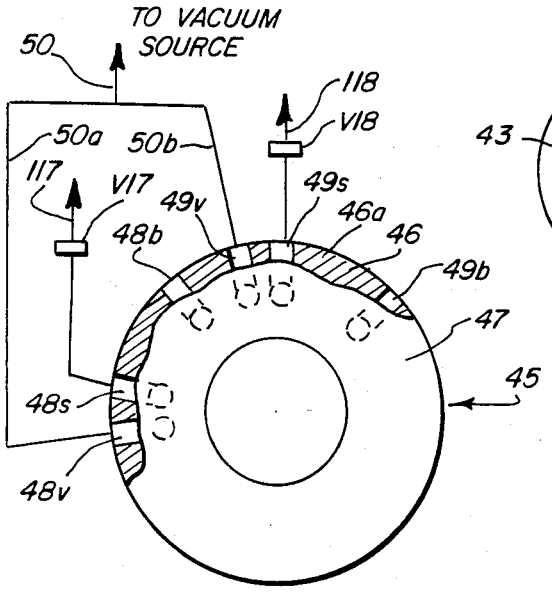
FIG. 8 is a diagrammatic view of the control means that causes a feeding means to selectively feed or not feed a signature.

Referring now to FIG. 8, a shaft 41*a* that carries the extracting cylinder 41 also carries a valve means, indicated generally at 45, which is of a common disc type illustrated in FIGS. 3–7 of U.S. Pat. No. 4,162,066; but without the "run" and "jog" modes of that patent. The valve means 45 cyclically connect the suckers 44 of the signature feeding stations 17 and 18 to a vacuum source. The valve means consists of a stationary porting center plate 46 which is flanked by two driven rotary fiber transfer discs, such as the disc 47, that are held between end plates (not shown). The porting plate 46 has passages 48*v*, 48*s* and 48*b* which connect with one of its faces 46*a*, and passages 49*v*, 49*s* and 49*b* which connect with its opposite face. The passages 48*v* and 49*v* are connected through respective conduit 50*a* and 50*b* to a vacuum line 50. The passages 48*s* and 49*s* are connected, respectively, to solenoid valves V17 and V18. The passages 48*b* and 49*b* are bleed ports. As is described in U.S. Pat. No. 4,162,066, the rotatable transfer discs 47 are provided with circumferential slots so that rotation of the discs places connecting conduits 117 and 118 for the suckers 44 of the signature feeding stations 17 and 18 cyclically in communication with the respective vacuum passages 48*v* and 49*v* and with the respective bleed ports 48*b* and 49*b*, so the suckers pick up and release signatures as required for machine operation.

The 1-up signature feeding stations 19 and 20 are controlled by another valve and conduit array like that illustrated in FIG. 8, and the same is true of the 1-up signature feeding stations 22 and 23.

Each of the 2-up stations 21 and 24 has a rotary disc valve 45*a* with a plate corresponding to the plate 46, but with one set of passages corresponding to 48*v*, 48*s* and 48*b*, and only one rotary fiber transfer disc corresponding to the disc 47.

Figure 9:
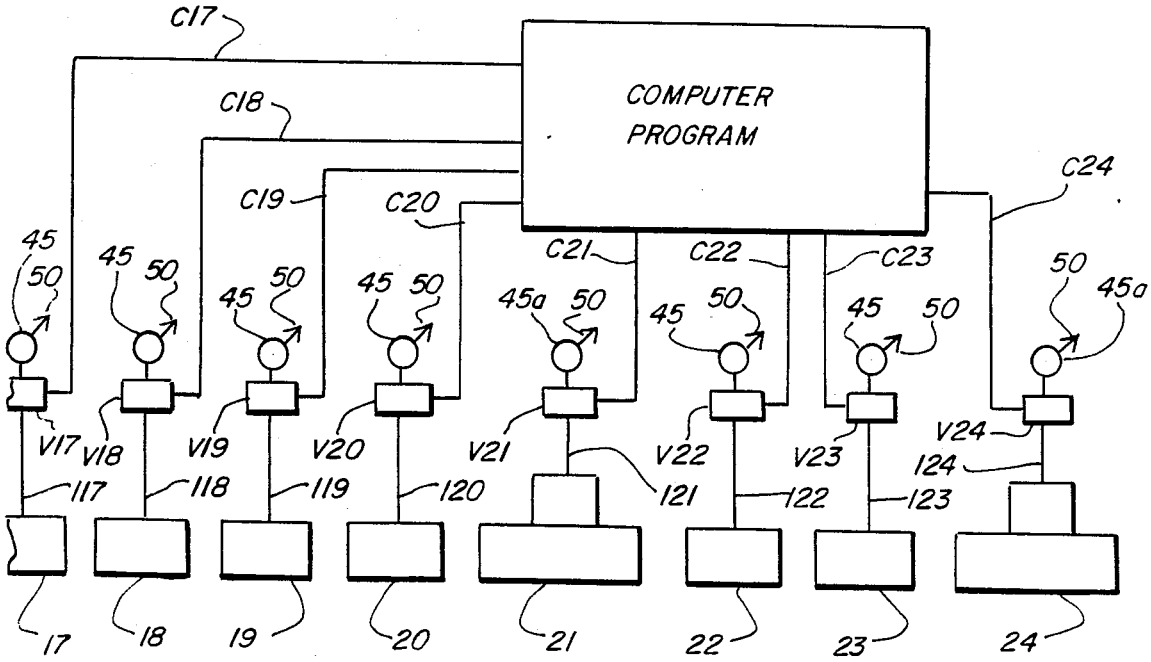
FIG. 9 is a diagrammatic view of the signature feeding stations of FIG. 1 with their selective feed control valves and connections to a computer program that causes the valves to be either open or closed.

In order that the suckers 44 of the various signature feeding stations 17 through 24 may be disabled in accordance with a predetermined program to selectively feed signatures from less than all the boxes 17 through 24, the respective connecting conduits 117 through 124, seen in FIG. 9, are all provided with respective solenoid valves V17 through V24 to control the cyclic connection of the various suckers 44 to the vacuum line 50 through the respective rotary disc valves 45 or 45*a*.

Operation of the several solenoid valves V17 through V24 is controlled in accordance with a computer program through the respective control connections C17 through C24. It is well known in the art to use computer programs to operate solenoid valves that selectively connect signature transfer suckers with rotary valves, such as the valves 45 and 45*a*, or that isolate the suckers from the rotary valves and thus interrupt connection of the suckers to the vacuum line 50; so no further detail of this part of the apparatus is believed to be necessary.

Turning now to FIGS. 2, 4 and 6, as illustrated in FIG. 4, usually each leading segment ls and each trailing segment ts of a receiving area ra of the chain 11 first receives a 1-up signature which, as indicated in FIG. 2, may be any of the signatures S17 through S20 in any desired kind of arrangement to provide the first signatures for a series of customized books. If desired, however, the 1-up signatures may be omitted either from a leading segment ls or from a trailing segment ts. As will be understood by those skilled in the art, the number and arrangement of signature feeding stations illustrated in FIG. 1 is merely exemplary, and for the purpose of illustrating the kind of flexibility that the present invention is capable of providing. Accordingly, there may be many more than four 1-up signature feeding stations before the first 2-up station, there may be more than one 2-up station after the first group of 1-up stations, and there may be more than two 1-up stations following one or more 2-up stations. Also, there may be another 1-up station after the station 24 which feeds the 2-up covers, so that an overwrap may overlie the cover of the trailing book. Thus, it is understood that FIG. 2 does no more than illustrate the fact that usually there is at least a bottom layer of 1-up signatures, that there may be at least one 2-up signature overlying one or more layers of 1-up signatures, that any signature on top of a 2-up signature must be in the trailing segment ts, and that the assembly includes a 2-up cover C.

FIG. 5 illustrates the closest prior art known to the inventor. In FIG. 5, a gathering chain 11 of a 2-up signature feeding apparatus has signature pusher lugs 12 spaced to receive 2-up signatures, and a short signature pusher leg 13 is located as illustrated with respect to a pusher lug 12 so that a 2-up insert I may be fed onto the gathering chain ahead of the short pusher leg 13 with the dividing line between the leading and trailing identical halves of the insert precisely in register with the dividing line between the two identical pages of a 2-up signature, or the two identical parts of a 2-up cover C. When a pack including an insert I is saddle stitched, trimmed, and severed into two books, one of the identical halves of the insert is bound in each of the two books.

Thus, although the use of a short pusher leg 13 between long pusher lugs 12 is not new, the location of the legs relative to the lugs was not one that permitted the feeding of both 1-up and 2-up signatures in a single book gathering operation.

The foregoing detailed description is given for clearness of understanding only and no unnecessary limitations are to be understood therefrom, as modifications will be obvious to those skilled in the art.

We claim:

1. Apparatus for gathering printed signatures and transporting them to a saddle stitcher, said apparatus comprising, in combination:

a line of several signature feeding stations, one part of the stations in said line being adapted to hold a supply of 1-up signatures and to feed said 1-up signatures seriatim, and another part of the stations in said line being adapted to hold a supply of 2-up signatures each of which has a forward page and a rearward page, and to feed said 2-up signatures seriatim;

a gathering chain running in front of said line of feeding stations, said gathering chain having spaced signature pusher lugs defining receiving areas each of which is long enough for a 2-up signature, and short signature pusher legs alternating with said signature pusher lugs to divide each receiving area into a leading segment and a trailing segment each of which is long enough for a 1-up signature, and the length of said short pusher legs being such that a 2-up signature overlying a leg is not materially distorted;

a supply of signatures at each feeding station;

means at each feeding station for feeding signatures seriatim from said supply into a receiving area on said chain to gather a pack of signatures in each receiving area;

a control means operatively associated with each signature feeding means, each said control means being constructed and arranged to cause the associated feeding means to selectively feed or not feed a signature in response to a signal;

and electronic programming means including first means for signalling at least a selected one of said control means to first feed at least one 1-up signature into at least one of the segments of each receiving area of the gathering chain, and second means for thereafter signalling at least one other selected control means to feed at least one 2-up signature into each receiving area of said gathering chain overlying all the 1-up signatures and the pusher leg in each said receiving area.

2. The combination of claim 1 in which the first means included in the electronic programming means signals at least a selected one of said control means to first feed at least one 1-up signature into each leading and trailing segment of each receiving area of the gathering chain.

3. The combination of claim 2 in which the electronic programming means includes third means for signalling at least one further selected control means to feed at least one further 1-up signature into a trailing segment of the gathering chain overlying only the rearward page of a 2-up signature, and fourth means for signalling at least one additional selected control means to feed at least one additional 2-up signature into each chain receiving area overlying all the signatures therein.

4. The combination of claim 3 in which the line includes a signature feeding station which contains a supply of 2-up covers, and the electronic programming means is arranged to feed a 2-up cover from said supply of 2-up covers onto each pack of signatures on the chain.

5. The combination of claim 1 in which the electronic programming means includes third means for signalling at least one further selected control means to feed at least one further 1-up signature into a trailing segment of the gathering chain overlying only the rearward page of a 2-up signature, and fourth means for signalling at least one additional selected control means to feed at least one additional 2-up signature into each chain receiving area overlying all the signatures therein.

6. The combination of claim 5 in which the line includes a signature feeding station which contains a supply of 2-up covers, and the electronic programming means is arranged to feed a 2-up cover from said supply of 2-up covers onto each pack of signatures on the chain.

7. The combination of claim 1 in which the line includes a signature feeding station which contains a supply of 2-up covers, and the electronic programming means is arranged to feed a 2-up cover from said supply of 2-up covers onto each pack of signatures on the chain.

8. Apparatus for gathering printed signatures into successive packs and transporting said packs to a saddle stitcher, said apparatus comprising, in combination:

a line of several signature feeding stations, one part of the stations in said line being adapted to hold a supply of 1-up signatures and to feed said 1-up signatures seriatim, and another part of the stations in said line being adapted to hold a supply of 2-up signatures each of which has a forward page and a rearward page, and to feed said 2-up signatures seriatim;

and a gathering chain running in front of said line of feeding stations, said gathering chain having spaced signature pusher lugs defining receiving areas each of which is long enough for a 2-up signature, and short signature pusher legs alternating with said signature pusher lugs to divide each receiving area into a leading segment and a trailing segment each of which is long enough for a 1-up signature, and the length of said short pusher legs being such that a 2-up signature overlying a leg is not materially distorted, whereby the apparatus may be selectively operated to gather packs consisting of 1-up signatures or 2-up signatures or a predetermined selection of both such signatures without rearrangement of the pusher legs and the pusher legs on the chain.

9. An apparatus for gathering printed signatures into successive packs for saddle stitching which includes a line of signature feeding stations and an endless gathering chain that has spaced pusher legs defining successive receiving areas each of which is long enough for a 2-up signature, the improvement comprising:

a short signature pusher leg is detachably secured to the gathering chain in each receiving area to divide each area into a leading segment and a trailing segment each of which is long enough for a 1-up signature, and the length of said short pusher legs is such that a 2-up signature overlying a leg is not materially distorted, whereby the apparatus may be selectively operated to gather packs consisting of 1-up signatures or 2-up signatures or a predetermined selection of both such signatures without rearrangement of the pusher lugs and the pusher legs on the chain.

10. A method of gathering printed signatures on an endless gathering chain which conveys a pack of said signatures to a saddle stitcher, said method comprising the successive steps of:

mounting signature pusher lugs on an endless gathering chain to divide it into receiving areas each of which is long enough to accommodate a 2-up signature;

mounting a short signature pusher leg in each receiving area to divide each said area into a leading segment and a trailing segment each of which is long enough to receive a 1-up signature, each said pusher leg being short enough that a 2-up signature overlying a leg is not materially distorted;

driving the chain so an upper run moves toward the stitcher;

dropping at least one 1-up signature into at least one of the segments of each receiving area in the upper run, straddling the chain;

and thereafter dropping at least one 2-up signature into each receiving area straddling the chain on top of the signature pusher leg and on top of any 1-up signatures that are in each receiving area, each said 2-up signature having a leading page in register with any 1-up signature that may be in the leading segment and a trailing page in register with any 1-up signature that may be in the trailing segment.

11. The method of claim 10 in which at least one 1-up signature is first dropped into each segment of each receiving area in the upper run.

12. The method of claim 11 which includes the further steps of dropping at least one additional 1-up signature into selected ones of the trailing segments straddling and in register with the trailing page of a 2-up signature, and thereafter dropping a 2-up cover signature into each receiving area in register with any 2-up signature already in a receiving area.

13. The method of claim 10 which includes the further steps of dropping at least one additional 1-up signature into selected ones of the trailing segments straddling and in register with the trailing page of a 2-up signature, and thereafter dropping a 2-up cover signature into each receiving area in register with any 2-up signature already in a receiving area.

14. The method of claim 10 in which a last 2-up signature dropped into each receiving area is a cover signature.

* * * * *